US010881893B2

(12) United States Patent
Welde et al.

(10) Patent No.: US 10,881,893 B2
(45) Date of Patent: Jan. 5, 2021

(54) OPEN BARBELL WITH STAND

(71) Applicant: Eleiko Group AB, Halmstad (SE)

(72) Inventors: Björn Welde, Halmstad (SE); Roy Simonson, San Clement, CA (US)

(73) Assignee: ELEIKO GROUP AB, Halmstad (SE)

( * ) Notice: Subject to any disclaimer, the term of this patent is extended or adjusted under 35 U.S.C. 154(b) by 0 days.

(21) Appl. No.: 16/395,751

(22) Filed: Apr. 26, 2019

(65) Prior Publication Data

US 2019/0247703 A1 Aug. 15, 2019

(30) Foreign Application Priority Data

Dec. 6, 2018 (SE) ..... 1851519

(51) Int. Cl.
*A63B 21/072* (2006.01)
*A63B 21/00* (2006.01)

(52) U.S. Cl.
CPC ..... *A63B 21/0724* (2013.01); *A63B 21/4035* (2015.10)

(58) Field of Classification Search
CPC ..... A63B 21/0724; A63B 21/4035; A63B 2208/0223; A63B 23/035; A63B 21/06–0607; A63B 21/072–08; A63B 21/0728; A63B 2023/0411
See application file for complete search history.

(56) References Cited

U.S. PATENT DOCUMENTS 2,722,419 A * 11/1955 Tarapczynski ..... A63B 21/0724 482/106
4,018,442 A * 4/1977 Galler ..... A63B 21/0724 482/106
4,274,628 A * 6/1981 Hoagland ..... A63B 21/0724 482/106
D261,788 S * 11/1981 Burns ..... D21/682
4,312,506 A * 1/1982 Brennan ..... A63B 21/0724 482/106
4,327,908 A * 5/1982 James ..... A63B 21/0724 482/105

(Continued)

FOREIGN PATENT DOCUMENTS

CN 2516191 Y 10/2002
GB 2499828 A 9/2013

(Continued)

OTHER PUBLICATIONS

Swedish Search Report from correlating Swedish Application No. 1851519-7, dated Jun. 13, 2019; 2 pages.

*Primary Examiner* — Nyca T Nguyen
(74) *Attorney, Agent, or Firm* — Tucker Ellis LLP

(57) ABSTRACT

A barbell includes first and second bar ends being substantially straight and extending along a first longitudinal axis. A central bar is connected to the bar ends in an angle, and with a mid-portion protruding a first distance from the first longitudinal axis. First and second handles, are connected to at least the central bar and protrudes in an open area between the bar ends. First and second counterweights, protruding a second distance from the first longitudinal axis, substantially in an opposite direction relative the central bar. The first and second counterweights and the second distance are selected so as to weight-balance the central bar.

16 Claims, 2 Drawing Sheets

(56) References Cited

U.S. PATENT DOCUMENTS 4,360,198 A * 11/1982 Waulters ..... A63B 21/078 482/106
4,461,473 A * 7/1984 Cole ..... A63B 21/0004 482/106
4,605,222 A * 8/1986 Shannon ..... A63B 21/0724 482/106
4,768,780 A * 9/1988 Hayes ..... A63B 21/0724 482/106
4,822,035 A * 4/1989 Jennings ..... A63B 21/0724 482/106
4,863,158 A * 9/1989 Tassone ..... A63B 21/0004 482/140
4,903,962 A * 2/1990 Pollack ..... A63B 21/0724 482/106
4,964,631 A * 10/1990 Marano ..... A63B 21/4013 482/105
D317,641 S * 6/1991 Gerard ..... D21/682
D320,249 S * 9/1991 Gerard ..... D21/682
D320,636 S * 10/1991 Eckler ..... D21/680
5,221,244 A * 6/1993 Doss ..... A63B 21/0724 482/106
5,679,105 A * 10/1997 Vittone ..... A63B 21/072 482/110
5,725,461 A * 3/1998 Bogard, II ..... A63B 21/072 482/106
5,836,858 A * 11/1998 Sharff ..... A63B 21/0724 482/106
5,967,948 A * 10/1999 Carr ..... A63B 21/072 482/106
6,004,245 A * 12/1999 Boos ..... A63B 21/072 482/106
6,010,439 A * 1/2000 Bullard, Jr. ..... A63B 21/078 482/106
D425,151 S * 5/2000 Landfair ..... D21/679
6,572,515 B2 * 6/2003 De La Garza ..... A63B 21/0724 482/106
6,663,542 B1 * 12/2003 Trabbic ..... A63B 21/0724 482/106
6,679,815 B2 * 1/2004 Vittone ..... A63B 21/06 482/106
7,056,268 B2 * 6/2006 Emick ..... A63B 21/0724 482/106
7,112,164 B1 * 9/2006 Hoagland ..... A63B 21/0724 482/106
8,047,973 B2 * 11/2011 Berenshteyn ..... A63B 21/0724 482/100
8,951,170 B1 * 2/2015 Tayo ..... A63B 21/0724 482/107
D725,722 S * 3/2015 Conaway ..... D21/679
D731,008 S * 6/2015 Orakwusi ..... D21/681
9,248,334 B2 * 2/2016 Dupuis ..... A63B 21/062
9,254,408 B1 * 2/2016 Otto ..... A63B 21/055
D776,209 S * 1/2017 Gilbert ..... D21/683
9,833,654 B1 * 12/2017 Gant ..... A63B 21/4035
9,855,460 B2 * 1/2018 Wilson ..... G08B 3/10
D816,782 S * 5/2018 Petek ..... D21/681
D834,660 S * 11/2018 Petek ..... D21/682
D845,404 S * 4/2019 Kuka ..... D21/679
2004/0242385 A1 * 12/2004 Emick ..... A63B 21/0783 482/106
2005/0192166 A1 * 9/2005 Shifferaw ..... A63B 21/078 482/94
2006/0040802 A1 * 2/2006 Vittone ..... A63B 21/0724 482/106
2016/0228738 A1 * 8/2016 Tansil ..... A63B 21/0004
2017/0106226 A1 * 4/2017 Mann ..... A63B 21/0724
2018/0178052 A1 * 6/2018 Rella ..... A63B 21/0724
2018/0296873 A1 * 10/2018 Amyan ..... A63B 21/00

FOREIGN PATENT DOCUMENTS

JP 3077683 B2 8/2000
WO 2013013358 A1 1/2013

* cited by examiner

OPEN BARBELL WITH STAND

RELATED APPLICATION DATA

This application claims the benefit of Swedish Patent Application No. 1851519-7, filed Dec. 6, 2018, the disclosure of which is incorporated herein by reference in its entirety.

TECHNICAL FIELD

The invention considers a barbell with the same function as barbells of the type called "trap bar", "hexagonal bar" or "hex bar", which considers a hexagon-shaped barbell in which a user is aligned with the bar during weight lifting. At these types of barbells, the user normally stands inside a hexagon-shaped bar and grasps the bar via side handles, wherein the center of gravity substantially aligns with the user during the lift or at least provides a closer or "inside" lift relative the center of gravity. The present invention concerns a barbell with this function.

BACKGROUND ART

Different kinds of barbells with the above described functionality have either a hexagonal design, like a barbell visible in US2018178052A or a so called open designed barbells or curved barbells, like the barbell presented in for example U.S. Pat. No. 2,722,419A or U.S. Pat. No. 9,833,654B. One problem with the hexagonal types is that the user must step inside the hexagonal barbell which might be a risk itself or exclude some users due to different handicaps or limited agility. Another problem is that certain exercises like spilt-squats are impossible to perform because of the back-side bar. The curved or open barbells have other negative issues like for example good balancing or positioning of the handles etc. Another issue is to, in an easy and comfortable way, provide a possibility to change weights. In US2018178052A this is taken care of by a special stand for the dumbbell, which is accessible from one side due to the open design.

SUMMARY OF THE INVENTION

It is an object of the invention to address at least some of the problems and issues outlined above. It is possible to achieve these objects and others by a barbell as defined in the attached independent claims.

According to an aspect of the invention, an open barbell is disclosed. The barbell comprises a first bar end and a second bar end, each arranged for carrying one or more weights. The first bar end and the second bar end are substantially straight and extends along a first longitudinal axis. Further, a central bar is arranged between the first and the second bar ends, which central bar is fixedly connected to the first bar end and the second bar end. The central bar is connected to the respective bar end in an angle relative the first longitudinal axis such as at least a mid-portion of the central bar is displaced from the longitudinal axis and protrudes a first distance from the first longitudinal axis. This means that at least a midportion is out of way of the user, which allows the user to stand in line with the longitudinal axis which also is the center of gravity. The form of the central bar may vary, for example it may be arcuate, half a square, half a rectangle, triangular etc.

A first handle is fixedly connected to at least one of the first bar end or the central bar, which first handle is substantially perpendicularly arranged relative the first bar end and facing the second bar end. The handle may of course have an angle relative the bar ends for comfort reasons or the like. Further, a second handle is fixedly connected to at least one of the second bar end or the central bar, which second handle is substantially perpendicularly arranged relative the second bar end and facing the first bar end. This handle may also have an angle relative the second bar end as discussed above and is normally a mirror-copy of the first handle.

A first counterweight is fixedly connected to at least one of the first bar end or the central bar, which means that it may be connected to either of them or both. The first counterweight protrudes a second distance from the first longitudinal axis, substantially in an opposite direction relative the central bar. A second counterweight is fixedly connected to at least one of the second bar end or the central bar and protruding the second distance from the first longitudinal axis, substantially in an opposite direction relative the central bar, in the same way as the first counter weight. The first and second counterweights and the second distance are selected so as to weight-balance the central bar, which means that the barbell has its center of gravity in line with the longitudinal axis and by that in line with the first and second bar end.

By this design a high comfort and well-balanced barbell is disclosed which allows a user to enter the barbell from behind without the risk of trip over the barbell and also allow the user to stand close to the center of gravity in a new and inventive way, not known in prior art.

According to an embodiment, the first counterweight comprises a first foot member which protrudes a third distance from the first longitudinal axis. Further, the second counter weight comprises a second foot member which protrudes the third distance from the first longitudinal axis, wherein the third distance is chosen so as to exceed a standard diameter of a standard weight. Since most weights have dimensions according to standards where the most common is so-called Olympic weight or Olympic disc, with a diameter of 450 mm, the third distance is chosen so as to exceed this dimension, to allow an easy tilting of the barbell in direction towards the foot members. Even with heavy weights with one or several weights positioned on the first and second bar ends, it is easy to tilt the barbell from the using position up to a standing/loading position on the foot members. In this position it is easy to shift weights in a comfortable way, which is not known in prior art solutions.

According to an embodiment, the mid-portion of the central bar is a straight bar, arranged parallel to the first longitudinal axis and at the first distance from the same. By having a straight mid-portion which extends a distance is good because it allows the user to stand in line or closer to the center of gravity and in that position have enough space to stand and perform squats or the like.

According to a preferred embodiment, the central bar and the first and second counterweights are manufactured in one piece. This means that these parts are produced as one bar-part preferably by a bending operation, and which bar is attached (welded) to the respective first and second bar ends as an arcuate bar, which forms an open space between the bar ends. By this, a robust, cost-efficient and well-balanced barbell is achieved compared to solution consisting of several parts which normally are welded together.

According to an embodiment, the central bar and the first and second counterweights are hollow tubes. Depending on if it is produced as one piece or not (like the nearest above embodiment) it is one continuous hollow tube or a number of pieces of hollow tubes welded to one piece.

In yet another preferred embodiment, the first and second foot members are hollow tubes. The hollow tubed foot members are fixedly connected to the counterweights preferably by welding and may be seen as a part of the counterweight. The respective foot member may be one tube welded to the end of the counterweight or may be two shorter tubes forming the foot member. The foot members preferably are arranged perpendicular to the respective counterweight.

According to an embodiment, at least one of the first counterweight and the first foot member comprises at least one first insert member, and at least one of the second counterweight and the second foot member comprises at least one second insert member. The insert members may be solid insert members or other types, with the function of balancing the total weight of the counterweights including the foot members and the inserts in correlation with the distance between the protruding foot members/counterweights and the distance and weight of the central bar, which protrudes in the opposite direction. Preferred is to use four insert members in combination with that the foot members are hollow tubes, and the respective insert member is inserted from the respective ends of the foot members.

According to an embodiment, the third distance is greater than 225 mm. The third distance is the distance from the longitudinal axis (the center axis of the bar ends) and the outermost part (the tangent point) of the foot members. This is to exceed the dimension of standard weights (Olympic weights) which has a diameter of 450 mm, and thus a radius of 225 mm. By at least exceed this distance, the foot members may act as supports or stands to allow the user to for example change weights, but still easily tilt the bar from the using position to the stand position.

According to a preferred embodiment, the third distance is chosen to be between 10-30 mm greater than a standard radius of a standard weight, which means that the third distance is between 235-255 mm.

A barbell, according to an aspect of the disclosure, includes a first bar end and a second bar end each arranged for carrying one or more weights, the first bar end and the second bar end being substantially straight and extending along a first longitudinal axis, a central bar arranged between the first and the second bar ends, which central bar is fixedly connected to the first bar end and the second bar end, wherein the central bar is connected to the respective bar ends at respective angles relative the first longitudinal axis such that at least a mid-portion of the central bar is displaced from the longitudinal axis and protrudes a first distance from the first longitudinal axis, a first handle, fixedly connected to at least one of the first bar end or the central bar, which first handle is substantially perpendicularly arranged relative the first bar end and facing the second bar end, a second handle, fixedly connected to at least one of the second bar end or the central bar, which second handle is substantially perpendicularly arranged relative the second bar end and facing the first bar end, a first counterweight, fixedly connected to at least one of the first bar end or the central bar and protruding a second distance from the first longitudinal axis, substantially in an opposite direction relative the central bar, a second counterweight, fixedly connected to at least one of the second bar end or the central bar and protruding the second distance from the first longitudinal axis, substantially in an opposite direction relative the central bar, wherein the first and second counterweights and the second distance are selected so as to weight-balance the central bar, wherein the barbell is open along the first longitudinal axis opposite the portion of the central bar that is displaced from the first longitudinal axis, wherein the first counterweight comprises a first foot member which protrudes a third distance from the first longitudinal axis, and the second counter weight comprises a second foot member which protrudes the third distance from the first longitudinal axis, wherein the third distance is chosen so as to exceed a standard radius of a standard weight, wherein the first bar end, the second bar end and the central bar are disposed in a plane through which the first longitudinal axis extends and, in a using position of the barbell with the plane parallel to a surface and edges of the weights resting on the surface, respective distal ends of the feet members are located below the plane and are spaced from the plane by a fourth distance that is less than the standard radius of the standard weight to allow rotation of the barbell about the first longitudinal axis in the using position, and wherein the third and fourth distances are set so that i) rotation of the barbell about the first longitudinal axis brings the distal ends of the feet members into contact with the surface, and ii) with the feet members in contact with the surface, the barbell is pivotable about locations of contact of the feet members with the surface to a position where the plane is perpendicular to the surface and the barbell is in a loading position with the edges of the weights displaced from the surface.

No part of the barbell contacts the surface in the using position, in one embodiment.

The feet members are curved between the distal ends of the feet members and the plane, in one embodiment.

In one embodiment, each foot member includes, as a first foot portion, the respective distal end below the plane in the using position and a first elongate portion connecting the distal end below the plane to the respective counterweight; and, as a second foot portion, a distal end above the plane in the using position and a second elongate portion connecting the distal end above the plane to the respective counterweight.

The feet members are symmetric about the plane, in one embodiment. In a further embodiment, the feet members are curved between the distal ends of the feet members and the plane.

The feet members are configured so that the barbell freely stands on the feet members in the loading position, in one embodiment.

According to still another aspect of the disclosure, a barbell includes a first bar end and a second bar end each arranged for carrying one or more weights, the first bar end and the second bar end being substantially straight and extending along a first longitudinal axis, a central bar arranged between the first and the second bar ends, which central bar is fixedly connected to the first bar end and the second bar end, wherein the central bar is connected to the respective bar ends at respective angles relative the first longitudinal axis such that at least a mid-portion of the central bar is displaced from the longitudinal axis and protrudes a first distance from the first longitudinal axis, a first handle, fixedly connected to at least one of the first bar end or the central bar, which first handle is substantially perpendicularly arranged relative the first bar end and facing the second bar end, a second handle, fixedly connected to at least one of the second bar end or the central bar, which second handle is substantially perpendicularly arranged relative the second bar end and facing the first bar end, a first counterweight, fixedly connected to at least one of the first bar end or the central bar and protruding a second distance from the first longitudinal axis, substantially in an opposite direction relative the central bar, a second counterweight, fixedly connected to at least one of the second bar end or the central bar and protruding the second distance from the first longitudinal axis, substantially in an opposite direction relative the central bar, wherein the first and second counterweights and the second distance are selected so as to weight-balance the central bar, wherein the barbell is open along the first longitudinal axis opposite the portion of the central bar that is displaced from the first longitudinal axis, wherein the first counterweight comprises a first foot member which protrudes a third distance from the first longitudinal axis, and the second counter weight comprises a second foot member which protrudes the third distance from the first longitudinal axis, wherein the third distance is chosen so as to exceed a standard radius of a standard weight, wherein the first bar end, the second bar end and the central bar are disposed in a plane through which the first longitudinal axis extends and, in a using position of the barbell with the plane parallel to a surface substrate and edges of the weights resting on the surface, substrate, respective distal ends of the feet members are located below the plane and are spaced from the plane by a fourth distance that is less than the standard radius of the standard weight to allow rotation of the barbell about the first longitudinal axis in the using position; and wherein no part of the barbell contacts the surface substrate in the using position.

Further possible features and benefits of this solution will become apparent from the detailed description below.

BRIEF DESCRIPTION OF DRAWINGS

The solution will now be described in more detail by means of exemplary embodiments and with reference to the accompanying drawings, in which.

DETAILED DESCRIPTION

Figure 1A:
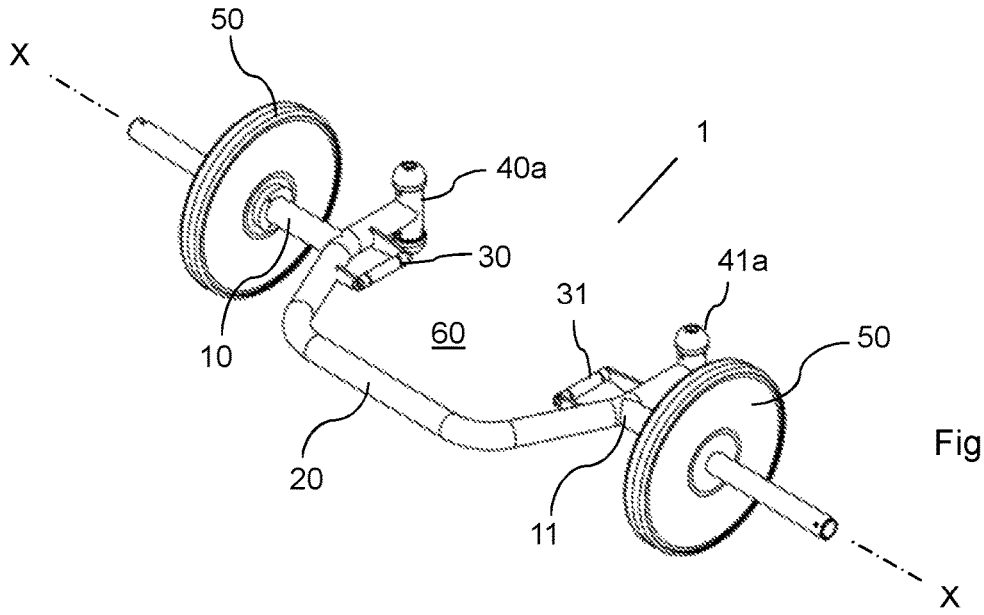
FIG. 1A is a perspective view of a barbell according to the invention in a using position.

Briefly described, an open or curved barbell with an easy "entrance" is provided, which allows a flexible and ergonomic use of the barbell. Further, a built-in stand is also provided as a part of counter-weights balancing the curved design.

FIGS. 1A-1D shows different views of a barbell 1 according to the invention, in a using position for weight-lifting. The barbell 1 has a main extension along a first longitudinal axis X-X, which axis is the same as a center of gravity. In the using position, the user may enter from behind and stand "inside" the barbell 1 due to the open design, in an open area 60. The front direction normally is with the barbell 1 in front of the user. The barbell 1 comprises a first bar end 10 (left side in the figures) and a second bar end 11 (right side in the figures), where each bar end 10, 11 is arranged for carrying one or more weights 50. The first bar end 10 and the second bar end 11 is substantially straight and extending along the first longitudinal axis X-X. A central bar 20 is arranged between the first and the second bar ends 10, 11, which central bar 20 is fixedly connected to the first bar end 10 and the second bar end 11. And according to the preferred embodiment the central bar 20 is one piece of hollow tube connected to the respective bar end 10, 11 in an angle relative the first longitudinal axis X-X. The design of the central bar 20 is such as at least an elongate mid-portion 25 of the central bar 20 has a second longitudinal axis C-C, which is displaced a first distance a from the longitudinal axis X-X.

To balance the central bar, by means of weight and distance (i.e. its center of gravity) a first counterweight 40 is fixedly connected to at least one of the first bar end 10 or the central bar 20 and protrudes a second distance b from the first longitudinal axis X-X, and substantially in an opposite direction relative the central bar 20. Also a second counterweight 41 is fixedly connected to at least one of the second bar end 11 or the central bar 20 and protrudes the second distance b from the first longitudinal axis X-X, and also substantially in an opposite direction relative the central bar 20. In the preferred embodiment, the first and second counterweights 40, 41 and the central bar 20 with its mid portion 25 is one piece of hollow tube, attached in an angle (more or less perpendicular) to the respective first and second bar ends 10, 11.

Further, a first handle 30 is fixedly connected to the central bar 20 near the connection between the first bar end 10 and the central bar 20, preferably in line with the first longitudinal axis X-X. The first handle 30 is substantially perpendicularly arranged relative the first bar end 10 and facing the second bar end 11. A second handle 31 is in the same way fixedly connected to the central bar 20, near the connection between the second bar end 11 and the central bar 20, preferably in line with the first longitudinal axis X-X. The second handle 31 is substantially perpendicularly arranged relative the second bar end 11 and facing the first bar end 10. The handles 30, 31 may also have other angles relative the bar ends 10, 11 is wanted.

The first counterweight 40 comprises a first foot member 40*a*, which protrudes a third distance c from the first longitudinal axis X-X, and the second counter weight 41 comprises a second foot member 41*a*, which protrudes the third distance c from the first longitudinal axis X-X. The third distance c is chosen so as to exceed a standard radius of a standard weight 50. The outer diameter of a standard weight (Olympic weight) is 450 mm, which means that the third distance c must exceed 225 mm to act as a stand. Of course, the third distance is adapted to allow a proper stand, allow the change of weights but also not be too high, because of the easiness of tilting a heavy loaded barbell from using position to loading/stand position. Also the first and second foot members 40*a*, 41*a* are hollow tubes and comprises insert members (not visible), which according to the preferred embodiment actually is a total of four insert members, two insert members per foot member 40*a*, 41*a*. Each insert member is inserted from respective ends of each foot member and the half-round end part visible in the figures are screwed into the respective insert member as a nice ending as well as a form enabling an easy tilting of the barbell 1.

Figure 1B:
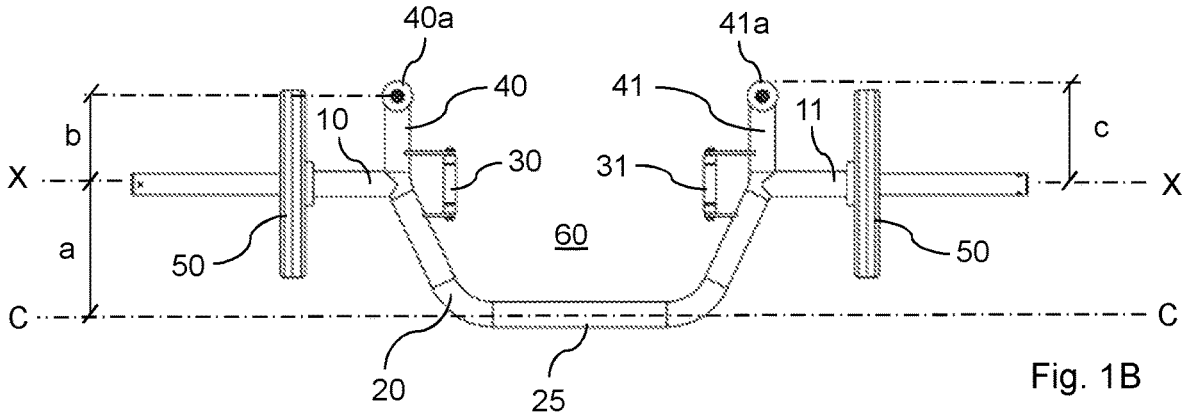
FIG. 1B is a top view of the barbell of FIG. 1A in the using position.

The first and second counterweights 40, 41 including the foot members 40*a*, 41*a* with their inserts together with the second distance b are selected so as to weight-balance the central bar 20, with its weight and the first distance a, which distances can be seen in FIG. 1B. The third distance c is as told earlier chosen to exceed the radius of the weights 50, which can be seen in FIG. 1D as well as in FIG. 2C. In FIG. 1B the open area 60 is visible and which area is mainly defined by the central bar 20 with its mid-portion 25 and the protruding counterweights 40, 41, but also the first and second handles 30, 31 limits the open area 60 a bit.

Figure 1C:
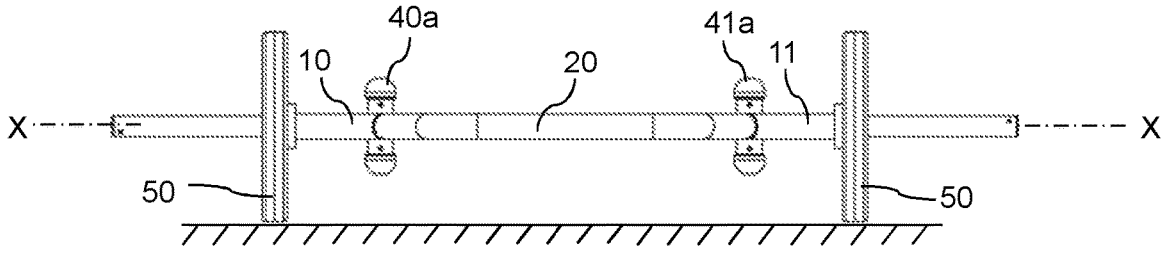
FIG. 1C is front view of the barbell of FIG. 1A in the using position.

In FIG. 1C the barbell 1 can be seen in the using position from the front, where the foot members 40*a*, 41*a* protrudes perpendicular to the first longitudinal axis X-X and the level of the first and second bar ends 10, 11 and the central bar 20 with its mid-portion 25.

Figure 1D:
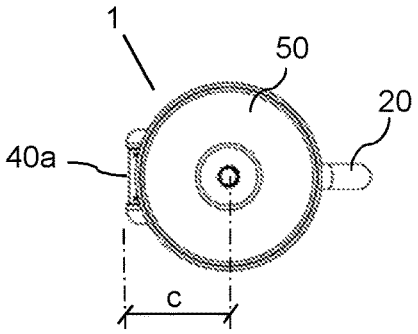
FIG. 1D is a side view of the barbell of FIG. 1A in the using position.

In FIG. 1D it becomes obvious why the invention enables a comfortable and easy tilting of the barbell from its using position, visible in the figure, to the stand position, since the foot members 40*a*, 41*a* only lifts the barbell 1 a short distance, but enough for a standing/loading position.

FIGS. 2A-2D shows different views of the barbell 1 according to the invention, in the loading position or stand position, where the weights 50 may be changed. Everything about the design of the barbell is more or less explained in relation to FIGS. 1A-1D, why this is not repeated in relation to FIGS. 2A-2D, but some comments are as follows.

Figure 2A:
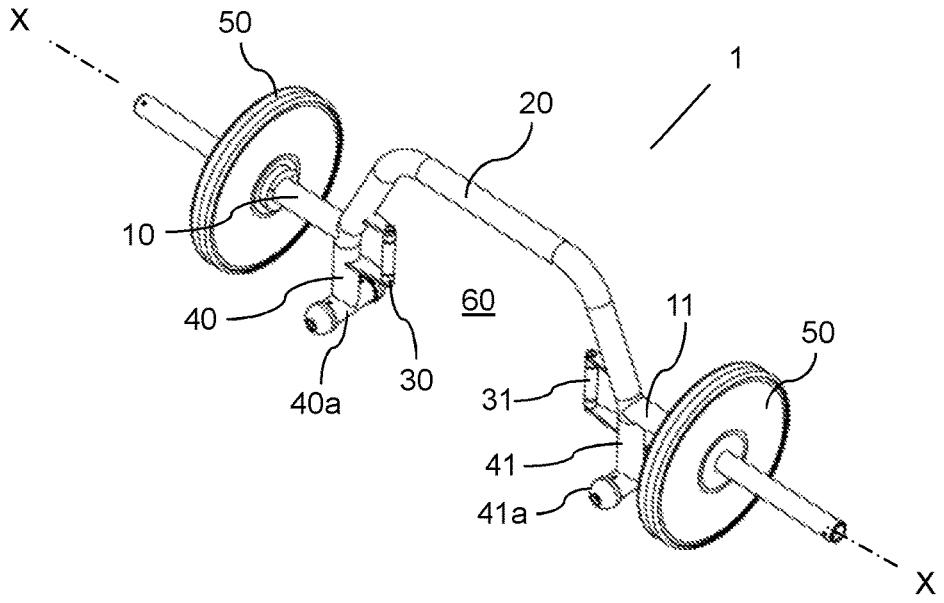
FIG. 2A is a perspective view of the barbell according to the invention in a standing/loading position, allowing a change of weights.
Figure 2B:
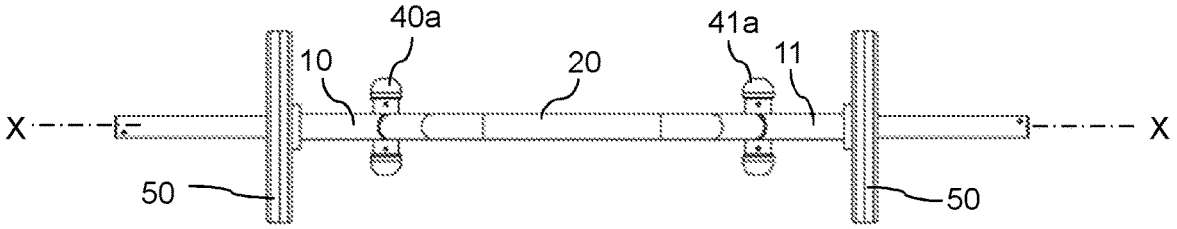
FIG. 2B is a top view of the barbell of FIG. 2A in the loading position.
Figure 2C:
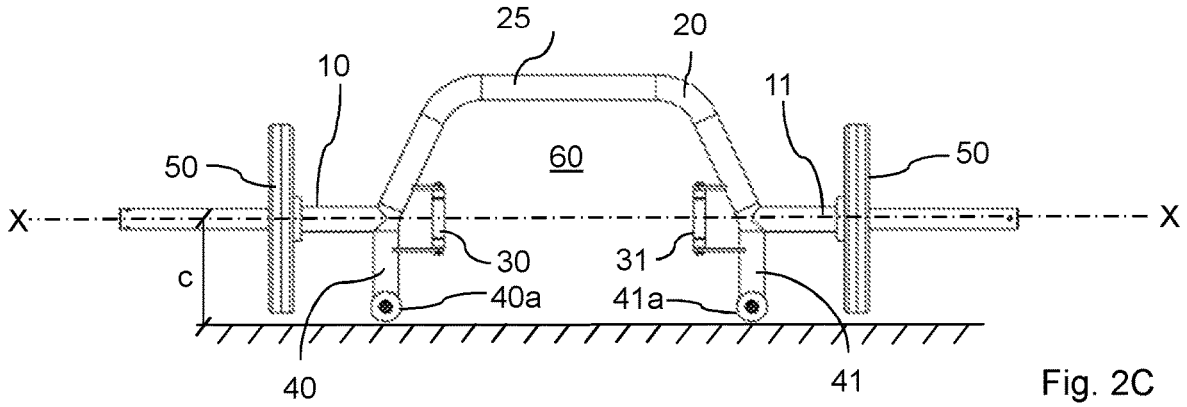
FIG. 2C is a front view of the barbell of FIG. 2A in the loading position.
Figure 2D:
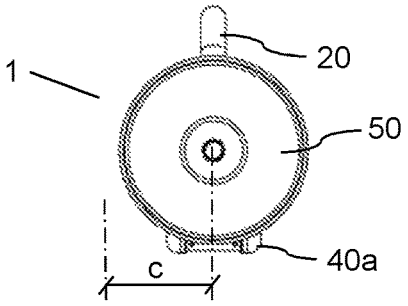
FIG. 2D is side view of the barbell of FIG. 2A in the loading position.

FIG. 2C is a front view of the barbell 1 in the loading and FIG. 2D is a side view of the barbell 1 in the loading position. In these figures, the function of the first and second counterweights 40, 41 including the foot members 41*a*, 41*a* as a stand, enabling a shift of weights 50, is understood. It is also easy to realize the easiness to tilt the barbell 1 back to the using position, for example by pushing the mid-portion 25 of the central bar a bit forward or backward.

Although the description above contains a plurality of specificities, these should not be construed as limiting the scope of the concept described herein but as merely providing illustrations of some exemplifying embodiments of the described concept. It will be appreciated that the scope of the presently described concept fully encompasses other embodiments which may become obvious to those skilled in the art, and that the scope of the presently described concept is accordingly not to be limited. Reference to an element in the singular is not intended to mean "one and only one" unless explicitly so stated, but rather "one or more." All structural and functional equivalents to the elements of the above-described embodiments that are known to those of ordinary skill in the art are expressly incorporated herein and are intended to be encompassed hereby.

The invention claimed is:

1. A barbell comprising:

a first bar end and a second bar end each arranged for carrying one or more weights, the first bar end and the second bar end being substantially straight and extending along a first longitudinal axis, a central bar arranged between the first and the second bar ends, which central bar is fixedly connected to the first bar end and the second bar end, wherein the central bar is connected to the respective bar ends at respective angles relative the first longitudinal axis such that at least a mid-portion of the central bar is displaced from the longitudinal axis and protrudes a first distance from the first longitudinal axis, a first handle, fixedly connected to at least one of the first bar end or the central bar, which first handle is substantially perpendicularly arranged relative the first bar end and facing the second bar end, a second handle, fixedly connected to at least one of the second bar end or the central bar, which second handle is substantially perpendicularly arranged relative the second bar end and facing the first bar end, a first counterweight, fixedly connected to at least one of the first bar end or the central bar and protruding a second distance from the first longitudinal axis, substantially in an opposite direction relative the central bar, a second counterweight, fixedly connected to at least one of the second bar end or the central bar and protruding the second distance from the first longitudinal axis, substantially in an opposite direction relative the central bar, wherein the first and second counterweights and the second distance are selected so as to weight-balance the central bar, wherein the barbell is open along the first longitudinal axis opposite the portion of the central bar that is displaced from the first longitudinal axis, wherein the first counterweight comprises a first foot member which protrudes a third distance from the first longitudinal axis, and the second counter weight comprises a second foot member which protrudes the third distance from the first longitudinal axis, wherein the third distance is chosen so as to exceed a standard radius of a standard weight, wherein the first bar end, the second bar end and the central bar are disposed in a plane through which the first longitudinal axis extends and, in a using position of the barbell with the plane parallel to a surface and edges of the weights resting on the surface, respective distal ends of the feet members are located below the plane and are spaced from the plane by a fourth distance that is less than the standard radius of the standard weight to allow rotation of the barbell about the first longitudinal axis in the using position, and wherein the third and fourth distances are set so that i) rotation of the barbell about the first longitudinal axis brings the distal ends of the feet members into contact with the surface, and ii) with the feet members in contact with the surface, the barbell is pivotable about locations of contact of the feet members with the surface to a position where the plane is perpendicular to the surface and the barbell is in a loading position with the edges of the weights displaced from the surface.

2. The barbell according to claim 1, wherein each foot member comprises:

as a first foot portion, the respective distal end below the plane in the using position and a first elongate portion connecting the distal end below the plane to the respective counterweight; and as a second foot portion, a distal end above the plane in the using position and a second elongate portion connecting the distal end above the plane to the respective counterweight.

3. The barbell according to claim 2, wherein the feet members are symmetric about the plane.

4. The barbell according to claim 3, the feet members are curved between the distal ends of the feet members and the plane.

5. The barbell according to claim 1, wherein the mid-portion of the central bar is a straight bar, arranged parallel to the first longitudinal axis and at the first distance from the first longitudinal axis.

6. The barbell according to claim 1, wherein the central bar and the first and second counterweights are comprised from one piece of bar material.

7. The barbell according to claim 1, wherein the central bar and the first and second counterweights are hollow tubes.

8. The barbell according to claim 1, wherein the first and second foot member are hollow tubes.

9. The barbell according to claim 1, wherein at least one of the first counterweight or the first foot member comprises at least one first insert member, and at least one of the second counterweight or the second foot member comprises at least one second insert member.

10. The barbell according to claim 1, wherein the third distance is greater than 225 mm.

11. The barbell according to claim 1, wherein the third distance is between 10-30 mm greater than the standard radius of the standard weight.

12. The barbell according to claim 1, wherein the first foot member and the second foot member are substantially perpendicularly arranged relative the first longitudinal axis.

13. The barbell according to claim 1, wherein no part of the barbell contacts the surface in the using position.

14. The barbell according to claim 1, wherein the feet members are curved between the distal ends of the feet members and the plane.

15. The barbell according to claim 1, wherein feet members are configured so that the barbell freely stands on the feet members in the loading position.

16. A barbell comprising:

a first bar end and a second bar end each arranged for carrying one or more weights, the first bar end and the second bar end being substantially straight and extending along a first longitudinal axis, a central bar arranged between the first and the second bar ends, which central bar is fixedly connected to the first bar end and the second bar end, wherein the central bar is connected to the respective bar ends at respective angles relative the first longitudinal axis such that at least a mid-portion of the central bar is displaced from the longitudinal axis and protrudes a first distance from the first longitudinal axis, a first handle, fixedly connected to at least one of the first bar end or the central bar, which first handle is substantially perpendicularly arranged relative the first bar end and facing the second bar end, a second handle, fixedly connected to at least one of the second bar end or the central bar, which second handle is substantially perpendicularly arranged relative the second bar end and facing the first bar end, a first counterweight, fixedly connected to at least one of the first bar end or the central bar and protruding a second distance from the first longitudinal axis, substantially in an opposite direction relative the central bar, a second counterweight, fixedly connected to at least one of the second bar end or the central bar and protruding the second distance from the first longitudinal axis, substantially in an opposite direction relative the central bar, wherein the first and second counterweights and the second distance are selected so as to weight-balance the central bar, wherein the barbell is open along the first longitudinal axis opposite the portion of the central bar that is displaced from the first longitudinal axis, wherein the first counterweight comprises a first foot member which protrudes a third distance from the first longitudinal axis, and the second counter weight comprises a second foot member which protrudes the third distance from the first longitudinal axis, wherein the third distance is chosen so as to exceed a standard radius of a standard weight, wherein the first bar end, the second bar end and the central bar are disposed in a plane through which the first longitudinal axis extends and, in a using position of the barbell with the plane parallel to a surface and edges of the weights resting on the surface, respective distal ends of the feet members are located below the plane and are spaced from the plane by a fourth distance that is less than the standard radius of the standard weight to allow rotation of the barbell about the first longitudinal axis in the using position; and wherein no part of the barbell contacts the surface in the using position.

* * * * *